United States Patent [19]

Asai

[11] Patent Number: 4,803,962

[45] Date of Patent: Feb. 14, 1989

[54] INTAKE PASSAGE APPARATUS FOR INTERNAL COMBUSTION ENGINE

[75] Inventor: Yoshiro Asai, Kyoto, Japan

[73] Assignee: Mitsubishi Jidosha Kogyo Kabushiki Kaisha, Tokyo, Japan

[21] Appl. No.: 142,330

[22] Filed: Mar. 15, 1988

Related U.S. Application Data

[63] Continuation of Ser. No. 830,553, Feb. 18, 1986, abandoned.

[30] Foreign Application Priority Data

Feb. 22, 1985 [JP] Japan ..... 60-23577[U]

[51] Int. Cl.[4] ..... F02B 75/18

[52] U.S. Cl. ..... 123/52 MC

[58] Field of Search ..... 123/52 M, 52 MB, 52 MC

[56] References Cited

U.S. PATENT DOCUMENTS

| | | | |
|---|---|---|---|
| 2,740,389 | 4/1956 | Reyl | 123/52 M |
| 3,831,566 | 8/1974 | Thomas | 123/52 M |
| 4,111,163 | 9/1978 | Ederer et al. | 123/52 M |
| 4,300,488 | 11/1981 | Cser | 123/52 M |
| 4,301,775 | 11/1981 | Smart et al. | 123/52 MC |
| 4,440,120 | 4/1984 | Butler | 123/52 MC |

*Primary Examiner*—David A. Okonsky

*Attorney, Agent, or Firm*—Hedman, Gibson, Costigan & Hoare

[57] ABSTRACT

Conventional intake passage apparatuses used in internal combustion engines, which have closed cross sections perpendicular to air current direction, have had to be manufactured by casting using cores. An intake passage apparatus according to the present invention comprises two divisions having their joint surfaces extending in the air current direction and bonded to each other by means of an adhesive agent. Also, the divisions are fixed by mechanical clamping. Thus, no closed cross sections are present in the divisions, so that the molding work is easier.

2 Claims, 1 Drawing Sheet

INTAKE PASSAGE APPARATUS FOR INTERNAL COMBUSTION ENGINE

BACKGROUND OF THE INVENTION

This application is a continuation of Ser. No. 830,553 filed Feb. 18, 1986 and now abandoned.

The present invention relates to an intake passage apparatus of an internal combustion engine.

In a conventional intake passage apparatus (e.g., U.S. Pat. No. 4,440,120) used in an internal combustion engine for a vehicle, an intake surge tank and an intake manifold for divergently supplying air from the air cleaner to engine cylinders are formed separately. However, each of the separate components is integrally formed by casting using cores. Therefore, these components have closed cross sections, and their manufacture requires much labor and costs high.

SUMMARY OF THE INVENTION

The present invention is contrived in consideration of these circumstances, and is intended to provide an intake passage apparatus with closed cross sections, whose ends connect with an air cleaner and an engine, individually, and in which a plurality of divisions divided substantially along the course of air current in the apparatus are airtightly bonded to one another by means of an adhesive agent, and are coupled together by mechanical fixing means.

Divided substantially along the course of air current, as described above, the divisions have no closed cross sections, and can therefore be manufactured by die casting, coreless casting, or injection molding. Thus, the apparatus can be manufactured with ease and at low cost.

DETAILED DESCRIPTION OF THE PREFERRED EMBODIMENTS

Figure 1:
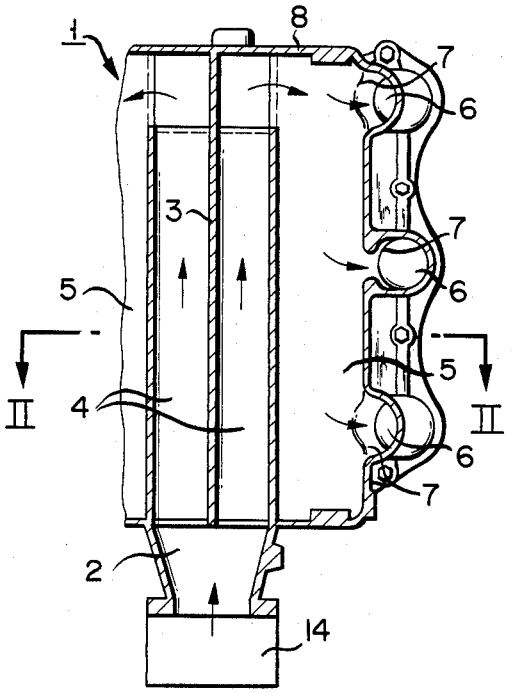
FIG. 1 is a sectional view showing a part of a surge tank according to an embodiment of the present invention.
Figure 2:
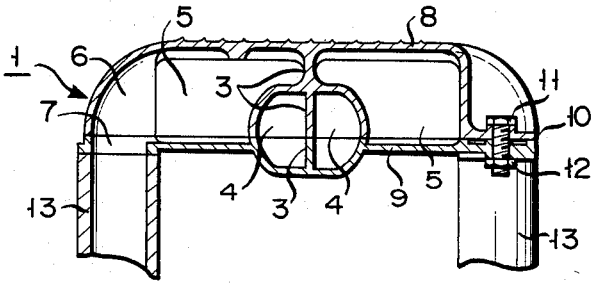
FIG. 2 is a sectional view taken along line II—II of FIG. 1.

In FIGS. 1 and 2, intake surge tank 1 constituting an intake passage apparatus serves to attenuate pulsation of intake air. It comprises an inlet section 2 connected to an air cleaner 14, passage section 4 coupled to section 2, and two tank sections 5 provided on either side of section 4. The passage section 4 includes two semicircular passages divided by partition plate 3. The inside space of each tank section 5 is outlined substantially in the shape of a rectangular prism. The upper half of passage section 4 cuts one lower edge portion of the prism. That end of each passage of the passage section 4 opposite to inlet section 2 connects with its corresponding tank section 5. Each tank section 5 is provided with three outlet portions 6. Each outlet portion 6 extends arcuately downward from the flank of tank section 5, defining outlet port 7 substantially flush with the bottom of section 5. Outlet ports 7 are connected with intake manifold 13 of the intake passage apparatus.

Intake surge tank 1 is divided into two divisions 8 and 9. Upper division 8 includes the upper half of passage section 4, the greater part of tank sections 5, and the bulk of outlet portions 6 integral with one another, while lower division 9 is integrally formed of the lower half of section 4, the bottom of sections 5, and outlet ports 7. Upper and lower divisions 8 and 9 are formed from aluminum, plastics, sheet metal, or cast iron by die casting, injection molding, pressing, or coreles casting.

An adhesive agent is applied to at least one of joint surfaces 10 including the lower surface of upper division 8 and the upper surface of lower division 9. By doing this, surge tank 1 is kept airtight, and the two divisions are rigidly bonded together. Also, divisions 8 and 9 are clamped and fixed by means of bolts 11 and nuts 12 at outlet portions 6. Bolts 11 and nuts 12 constitute fixing means of the invention.

As described above, intake surge tank 1 is vertically divided by joint surfaces 10, and upper and lower divisions 8 and 9 have no closed cross sections. Therefore, divisions 8 and 9 can be formed by die casting, injection molding, pressing, coreless casing, etc., without using any cores. Thus, tank 1 can easily be manufactured at low cost.

Passage section 4 need not always be provided with partition plate 3.

Although intake surge tank 1 has been described in detail in connection with the illustrative embodiment, other components of the intake passage apparatus connecting the air cleaner and engine can enjoy the same effects of the embodiment if they are divided substantially parallel to the course of air flow therein. These components include, for example, an air duct connecting the air cleaner and tank 1, intake manifold 13 connecting tank 1 and the engine, etc. If manifold 13 is divided in manufacture, in particular, its inner surface can be ground with ease, thus improving the efficiency of air supply and hence the combustion efficiency of the engine.

What is claimed is:

1. An intake passage apparatus of an internal combustion engine disposed between an air cleaner and engine cylinders for supplying air to the cylinders, said apparatus comprising:

a surge tank including two divisions having respective flat surfaces superimposable on each other and extending along an air flow passing through the surge tank, the surge tank having first and second passages connected to the air cleaner for receiving a flow of air from the air cleaner, a partition plate for partitioning the first and second passages from each other, a first tank section communicating with the first passage for receiving the air from the first passage, and a second tank section communicating with the second passage for receiving air from the second passage wherein the first and second passages and the first and second tank sections are formed when the flat surfaces of the two divisions are superimposed on each other and joined together;

at least one adhesive agent layer interposed between the joined surfaces to thereby bond the two divisions in airtight relationship;

fixing means operatively connected to the joined surfaces of the two divisions for mechanically clamping and fixing the two divisions together; and an intake manifold connected to the first and second tank sections for providing a flow of air from the tank sections to the engine cylinders.

2. The intake passage apparatus according to claim 1, wherein said first and second passages extend in a straight line, and said first and second tanks are arranged on either side of the passage sections.

* * * * *

UNITED STATES PATENT AND TRADEMARK OFFICE

CERTIFICATE OF CORRECTION

PATENT NO. : 4,803,962

DATED : February 14, 1989

INVENTOR(S) : Yoshiro Asai

It is certified that error appears in the above-identified patent and that said Letters Patent is hereby corrected as shown below:

On the title page,
item [22], change the filing date of U.S. Serial No. 142,330 from March 15, 1988 to read "December 30, 1987".

Signed and Sealed this
Twelfth Day of December, 1989

*Attest:*

JEFFREY M. SAMUELS

*Attesting Officer* *Acting Commissioner of Patents and Trademarks*